United States Patent [19]

Suzuki

[11] Patent Number: 4,583,839

[45] Date of Patent: Apr. 22, 1986

[54] IMAGE RECORDING APPARATUS HAVING AUTOMATIC IMAGE DENSITY REGULATION FUNCTION

[75] Inventor: Koji Suzuki, Yokohama, Japan

[73] Assignee: Canon Kabushiki Kaisha, Tokyo, Japan

[21] Appl. No.: 478,346

[22] Filed: Mar. 24, 1983

[30] Foreign Application Priority Data

Apr. 2, 1982 [JP] Japan ..... 57-53749

[51] Int. Cl.[4] ..... G03G 15/00

[52] U.S. Cl. ..... 355/14 R; 355/14 E; 355/14 D

[58] Field of Search ..... 355/14 R, 14 C, 14 CH, 355/14 D, 14 E, 67-69, 77; 430/35, 54, 55, 902, 30, 31

[56] References Cited

U.S. PATENT DOCUMENTS

| | | | |
|---|---|---|---|
| 2,956,487 | 10/1960 | Giaimo, Jr. | 355/14 D |
| 4,153,364 | 5/1979 | Suzuki et al. | 355/14 E |
| 4,200,391 | 4/1980 | Sakamoto et al. | 355/68 X |
| 4,239,374 | 12/1980 | Tatsumi et al. | 355/14 E |
| 4,306,804 | 12/1981 | Sakamoto et al. | 355/14 D X |
| 4,341,460 | 7/1982 | Kohyama | 355/14 R X |
| 4,344,699 | 8/1982 | McIntosh | 355/68 X |
| 4,352,553 | 10/1982 | Hirahara | 355/14 E |
| 4,358,520 | 11/1982 | Hirayama | 430/902 X |

*Primary Examiner*—R. L. Moses
*Assistant Examiner*—J. Pendegrass
*Attorney, Agent, or Firm*—Fitzpatrick, Cella, Harper & Scinto

[57] ABSTRACT

An image recording apparatus such as a copying machine has a surface potentiometer for detecting the surface potential of the original image, a microcomputer for integrating the measured surface potential, AC and DC development bias control circuits for controlling the development bias, and a lamp regulator for controlling exposure. In accordance with the integrated value of the surface potential, the development bias or exposure is controlled so as to allow production of an image having excellent gradation even when the original is a halftone image such as a photograph. The apparatus allows selection between automatic or manual control of development bias and exposure.

8 Claims, 6 Drawing Figures

| FIG. 1A | FIG. 1B |
|---|---|

IMAGE RECORDING APPARATUS HAVING AUTOMATIC IMAGE DENSITY REGULATION FUNCTION

BACKGROUND OF THE INVENTION

1. Field of the Invention

The present invention relates to an image recording apparatus which allows adjustment of image density by controlling image formation conditions in accordance with the density of an original image.

2. Description of the Prior Art

In a conventional image recording apparatus such as an electronic copying machine, methods are adopted wherein the density of an original image is detected by an image sensor such as a phototransistor and the light quantity for original exposure is controlled in accordance with the detected density, or the surface potential of the original image on a photosensitive body is detected by a surface potentiometer and the light quantity for original exposure and development bias are changed in real time.

However, from the viewpoints of sensitivity stability or charging characteristic stability of the photosensitive body, these methods have a drawback of unstable copy density for an original of the same density. Furthermore, depending upon the original, the reproduced image may have an irregular density in the scanning direction.

When the original density is read, the peak value of the density of the background of the original may be read, and the image formation conditions such as exposure or development bias may be changed according to the detected peak value. In this case, if an original is a document which only has two gray levels corresponding to characters and background, a clear copy may be automatically obtained. However, with a halftone image such as a photograph, a copy of only a few gray levels may be obtained.

SUMMARY OF THE INVENTION

It is an object of the present invention to provide an image recording apparatus which eliminates the above-mentioned drawback and which allows high-quality image recording irrespective of types of the original.

It is another object of the present invention to provide an image recording apparatus which allows automatic adjustment of an image density in accordance with the image density of an original of a halftone image.

It is still another object of the present invention to provide an image recording apparatus which detects and integrates an original density and which controls image formation conditions in accordance with the integrated value of the original density.

The above and other objects and advantages of the present invention will become apparent from the following description when taken in conjunction with the accompanying drawings.

DETAILED DESCRIPTION OF THE PREFERRED EMBODIMENT

The preferred embodiment of the present invention will now be described in detail with reference to the accompanying drawings.

Figures 1, 1A:
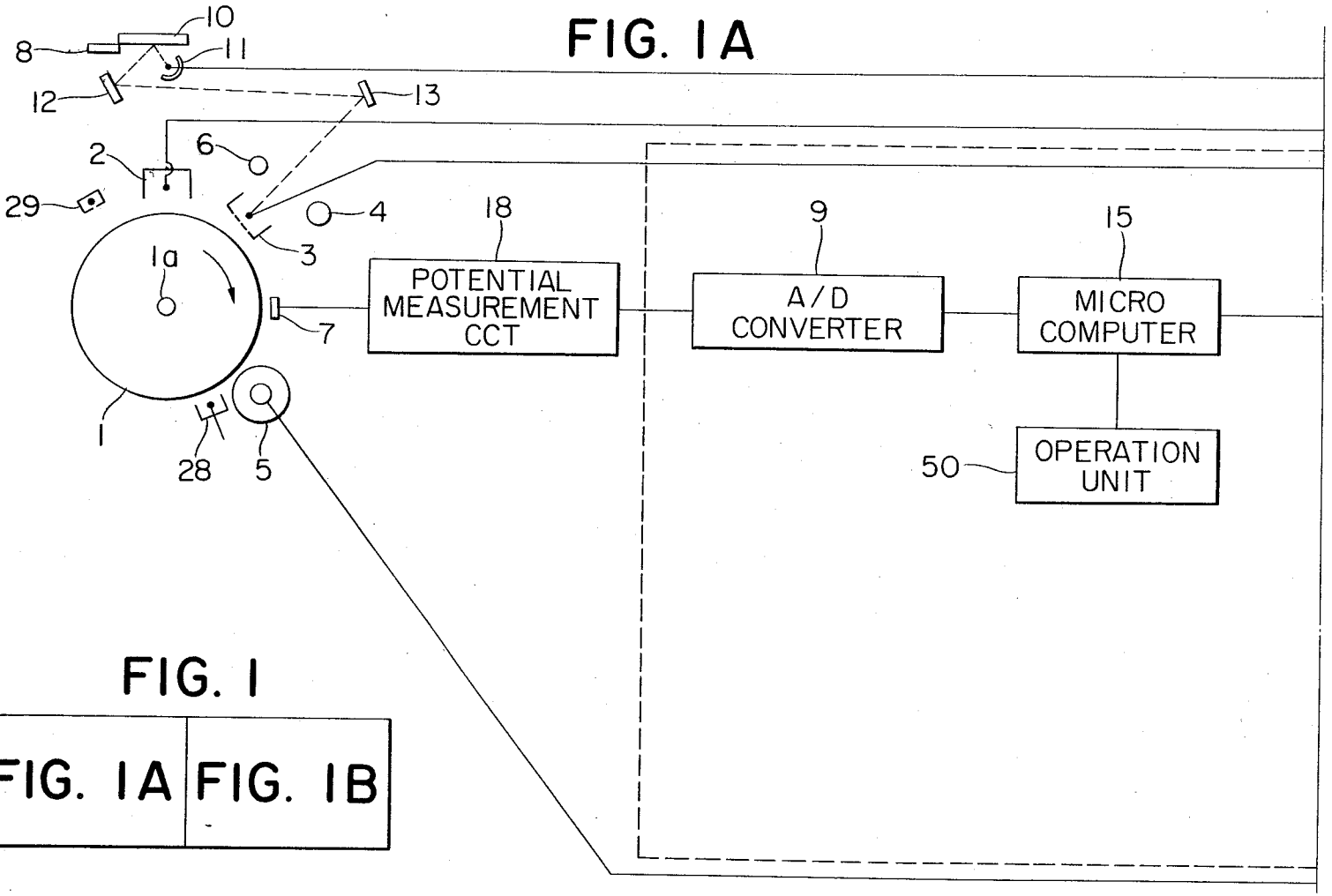
FIG. 1 composed of FIGS. 1A and 1B is a block diagram showing the configuration of an image recording apparatus according to the present invention.
Figure 1B:
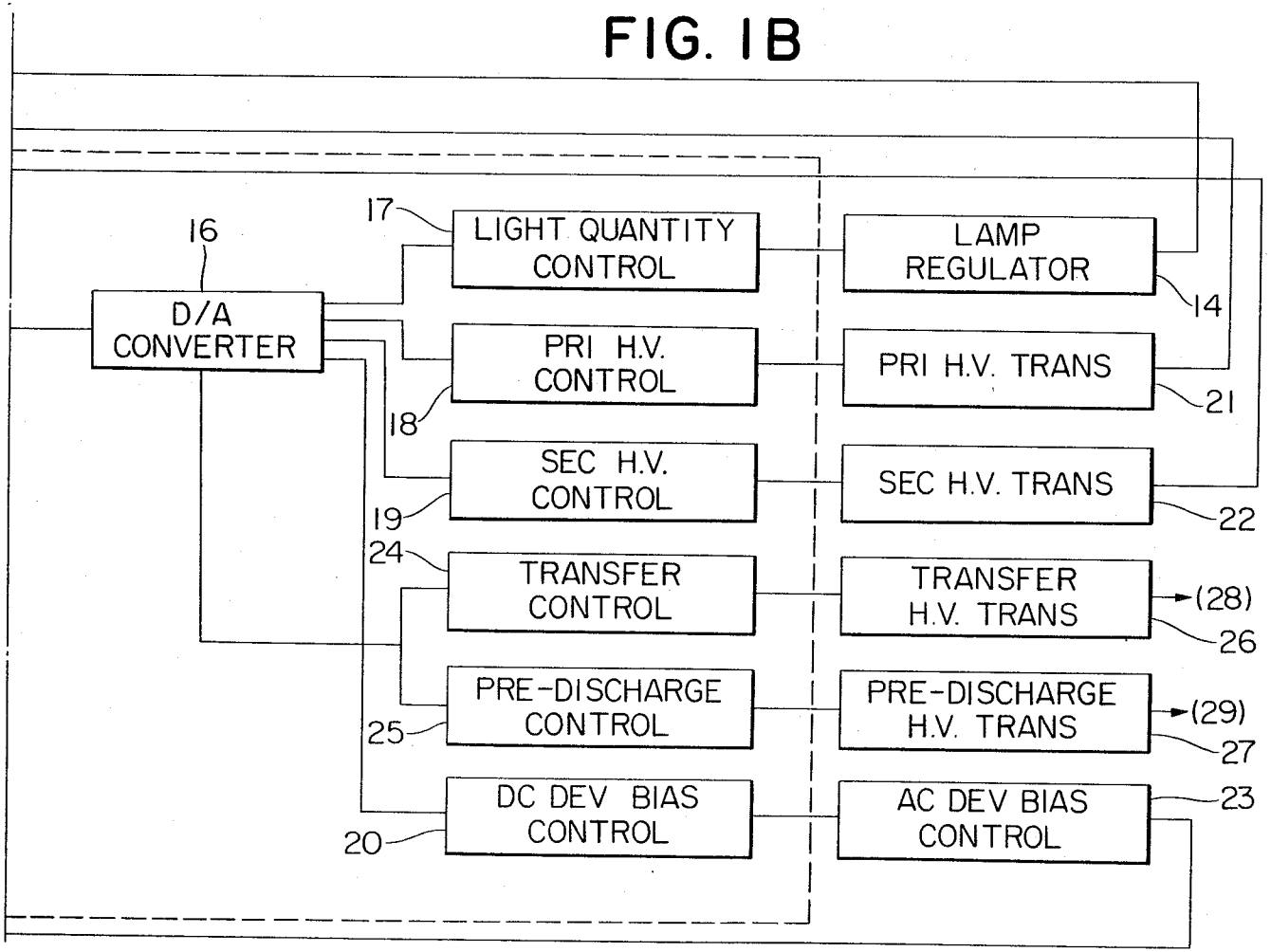

FIG. 1 shows a schematic block diagram of an image recording apparatus according to the present invention. A photosensitive body or drum 1 comprises three layers of an insulating layer, a photoconductive layer and an electrically conductive layer, and is supported to be rotatable in the direction indicated by the arrow about a shaft 1*a* coupled to the main body (not shown). Around the photosensitive drum 1 are sequentially arranged, along the direction of its rotation, a primary charger 2, a secondary charger 3, an entire surface exposure lamp 4, a surface potentiometer 7, a developing roller 5 for the development unit, a transfer charger 28, and a pre-discharge charger 29.

The photosensitive drum 1 is subjected to pre-discharging by the charger 29 prior to other processes. After the photosensitive drum 1 is uniformly charged by the primary charger 2, it is exposed by reflected light through mirrors 12 and 13 from an original 10 illuminated by an original exposure lamp 11. Simultaneously, the surface of the photosensitive drum 1 is discharged by the secondary charger 3 in accordance with the image of the original so as to form an electrostatic latent image thereon. After the image is exposed by the entire surface exposure lamp 4, it is developed into a toner image by the developing roller 5. As will be described later, an AC bias voltage is applied to the developing roller 5, and the excellent gradation of the image is obtained by the jumping phenomenon. Subsequently, the transfer charger 28 is energized to transfer the toner image onto a transfer sheet. A blank exposure lamp 6 is arranged above the secondary charger 3, and is ON during the rotating period of the photosensitive drum 1 except for the original exposure period. Thus, the blank exposure lamp 6 serves to prevent an excess portion of toner to be attached to the photosensitive drum 1. As will be described later, the blank exposure lamp 6 also serves to form bright and dark portions on the photosensitive drum 1 for standardization of the image formation conditions.

The surface potentiometer 7 for measuring the surface potential of the photosensitive drum 1 is interposed between the entire exposure lamp 4 and the developing roller 5. A signal from the surface potentiometer 7 is supplied to an A/D converter 9 through a potential measuring circuit 18 to be converted to a digital signal. The digital signal is then supplied to a microcomputer (to be referred to as an MPC hereinafter) 15. The output end of the MPC 15 is connected to a D/A converter 16 to which are connected a light quantity control 17, a primary high-voltage control 18, a secondary high-voltage control 19, a transfer control 24, a pre-discharge control 25, and a DC development bias control 20. The light quantity control 17 controls the exposure lamp 11 through a lamp regulator 14. The primary and secondary high-voltage controls 18 and 19 are respectively connected to the primary and secondary chargers 2 and 3 through primary and secondary high-voltage transformers 21 and 22, respectively, so as to control their charge statuses. The transfer control 24 is connected to the transfer charger 28 through the transfer high-voltage transformer 26, and the pre-discharge control 25 is connected to the pre-discharge charger 29 through the pre-discharge high-voltage transformer 27. The output end of the DC development bias control 20 is connected to an AD development bias control 23. An output from the AD development bias control 23 is applied to the developing roller 5. A standard white plate 8 is used for light quantity control of the original exposure lamp 11 as will be described later. A control panel 50 has various keys and displays.

Figure 2:
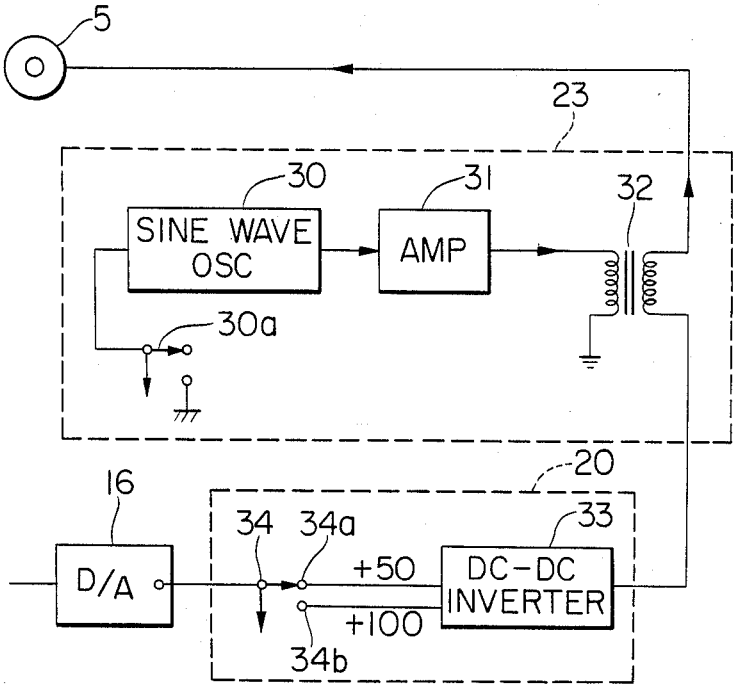
FIG. 2 is a block diagram showing the configuration of a control for controlling the development bias voltage.

The DC development bias control 20 and the AC development bias control 23 have the configuration as shown in FIG. 2. More specifically, a sine wave oscillator 30 is connected to an amplifier 31. An AC voltage from the sine wave osillator 30 is applied to the primary winding of a stepup transformer 32. A voltage induced in one end of the secondary winding of the stepup transformer 32 is applied to the developing roller 5. The other end of the secondary winding of the stepup transformer 32 is connected to a DC-DC inverter 33 and to the D/A converter 16 through a switch 34, thus constituting a DC development bias control shown in FIG. 1. As will be described later, the switch 34 is a switch to allow a selection between manual exposure or automatic exposure. In the automatic exposure mode, the switch 34 is connected to the side of a contact 34*a*. In the manual exposure mode, the switch 34 is connected to the side of a contact 34*b*. Thus, the switch 34 serves to produce DC development bias voltages of different levels in different modes.

Figure 3:
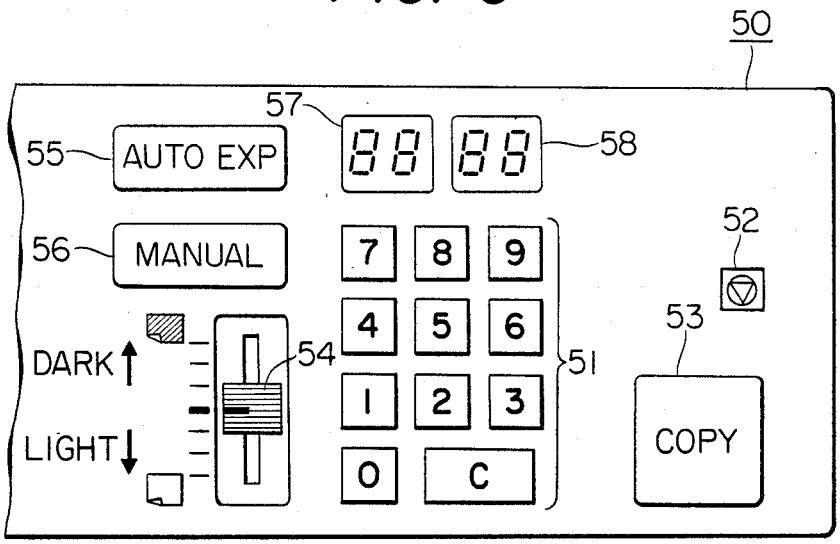
FIG. 3 is a plan view showing the part of a control panel 50 of the apparatus shown in FIG. 1.

FIG. 3 is a plan view showing a part of the control panel 5 of the apparatus or copying machine shown in FIG. 1.

Ten keys 51 are for setting the number of copies to be produced. By depressing keys "0" to "9", a maximum of 99 copy number may be preset in a display 57. A clear key "C" may be used for clearing the content of the display 57.

A stop key 52 may be depressed for stopping the copying machine before the number of copies produced reaches the number set in the display 57. When the stop key 52 is depressed, the current copying operation is completed and then the copy cycle is terminated thereafter. When a start key 53 is depressed, the copy cycle may be initiated. Displays 57 and 58 comprise 7-segment displays comprising light-emitting diodes, liquid crystal displays or the like and respectively display the number of copies to be produced and the number of copies already produced. A lever 54 may be slid in a desired direction so as to select the voltage of the original exposure lamp 11 and to thereby adjust the image density. Automatic and manual exposure mode keys 55 and 56 may be depressed to select the corresponding modes. The key 56 allows the input from the lever 54 and also allows the manual selection of image density. It is also possible to select the development bias voltage by the lever 54 so as to determine the density.

The automatic and manual exposure modes will now be described. In the automatic exposure mode, the apparatus or copying machine is first standardized with standard white light. Then, the image density of an image of an original is detected. In accordance with a detection output, the image formation conditions such as the ON voltage of the original exposure lamp is controlled. Prior to normal original exposure, the original is exposed and the potential of the electrostatic latent image is measured by the potentiometer 7. The surface potential of the image is integrated, and the ON voltage of the original exposure lamp is determined in accordance with the integrated value. In the automatic exposure mode, the input from the lever 54 is disabled.

In the manual exposure mode, the photosensitive drum 1 is illuminated with standard white light and the potential of the illuminated portion is detected. The ON voltage of the original exposure lamp is controlled in accordance with the measured potential. Illumination of the photosensitive drum 1 with standard white light is performed by irradiating the standard white plate 8 with the light quantity equivalent to that obtainable at the middle position of the lever 54, and directing the reflected light form the standard white plate 8 onto the photosensitive drum 1. In the manual exposure mode, the input from the lever 54 is enabled. Blank lamp light may also be used as standard white light. The element to be controlled by the detected potential is not limited to the original exposure lamp but may be extended to a development bias voltage or a corona charger.

Figure 4:
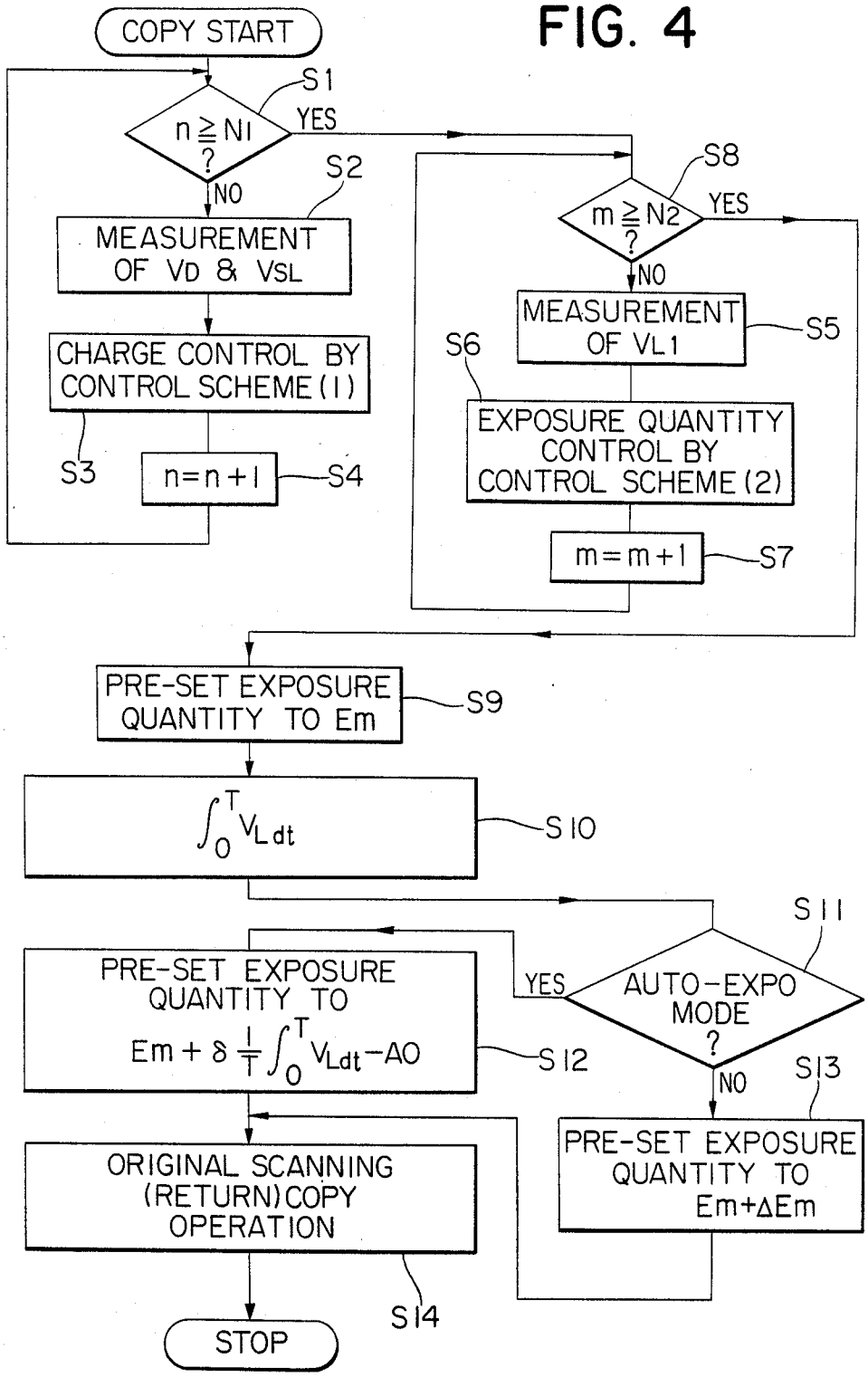
FIG. 4 is a flowchart showing the control flow of the apparatus shown in FIG. 1.

FIG. 4 shows a control flowchart for explaining the mode of operation of the apparatus according to the embodiment of the present invention described above.

In the apparatus of the configuration as shown in FIGS. 1 to 3, when the start or copy key is depressed, the original exposure lamp 11 and the blank exposure lamp 6 are turned on prior to image recording. Then, a bright potential $B_{SL}$ with intense light and a dark potential $V_D$ with off lamp are formed on the photosensitive drum 1. The potentials are detected by the surface potentiometer 7 (step S2 in FIG. 4). The detection outputs from the potentiometer 7 are converted to predetermined levels by the potential measuring circuit 18 and are then converted to digital signals by the A/D converter 9. Control data is then produced such that the bright potential $V_{SL}$ and the dark potential $V_D$ approach target values, respectively, in the MPC 15. That is, primary and secondary currents $I_1$ and $I_2$ flowing in the primary and secondary chargers 2 and 3 are controlled in step S3 in accordance with control scheme (1) below:

$$\left.\begin{aligned}\Delta I_1 &= \alpha_1 \Delta V_D + \alpha_2 \Delta V_{SL}\\ \Delta I_2 &= \beta_1 \Delta V_D + \beta_2 \Delta V_{SL}\end{aligned}\right\} \quad (1)$$

where $\Delta I_1$ and $\Delta I_2$ are increments, $\Delta V_D$ and $\Delta V_{SL}$ are deviations from the target values, and $\alpha_1$, $\alpha_2$, $\beta_1$ and $\beta_2$ are control coefficients.

The control data is converted to the analog data by the D/A converter 16 and is supplied to the primary and secondary high-voltage controls 18 and 19. The primary high-voltage control 19 controls the primary high-voltage transformer 21 so as to control the charge status of the primary charger 2. Similarly, the secondary high-voltage control 19 controls the secondary high-voltage transformer 22 so as to control the charge status of the secondary charger 3. In this manner, the potentials $V_{SL}$ and $V_D$ are controlled to approach the target values.

Such charge control operation is performed for Nl times which differs depending upon the discharge time, as seen from step S1. When the number n of charge control operations is smaller than N1 (step S1), n is incremented by 1 in step S4 and the flow returns to step S1 for another charge control operation.

When YES finally is obtained in step S1, the blank exposure lamp 6 is turned off, and the standard white plate (not shown) disposed outside the image region of the original 10 is illuminated with light from the original exposure lamp 11 (step S5). The exposure of the original exposure lamp 11 is thus controlled. The first illumination of the standard white plate is performed by converting the predetermined data from the MPC 15 to the analog data by the D/A converter 16 and supplying the ON voltage regulated by the lamp regulator 14 to the exposure lamp 11. The reflected light from the standard white plate by the first exposure is guided onto the photosensitive drum 1 through the mirrors 2 and 3. The potential (white potential $V_{L1}$) corresponding to white background which is established on the surface of the photosensitive drum 1 is measured through the surface potentiometer 7 and the potential measuring circuit 18 (step S5). The measured potential is converted to digital data by the A/D converter 9, and the digital data is supplied to the MPC 15. The MPC 15 performs an operation according to a control scheme (2) $\Delta V_{HL}=\gamma_1\Delta V_{L1}$ where $\Delta V_{L1}$ is a deviation from a target value and $\gamma_1$ is a constant (step S6). The calculation result is converted to analog data by the D/A converter 16, and the analog data is supplied to the lamp regulator 14 to control the exposure of the original exposure lamp 11 such that the white potential $V_{L1}$ reaches a target value. Such exposure control operations are performed N2 times as in the case of discharge control operation. After each exposure control operation, the number of times m of actual exposure control operations performed is incremented by 1 and it is then discriminated in step S8 if m has reached N2.

The apparatus may be modified such that the control operations are interrupted before n and m respectively reach N1 and N2 if the $V_D$, $V_{SL}$ AND $V_{L1}$ reach the target values.

When the exposure control operation is performed N2 times in this manner (YES in step S8), the exposure is preset to final exposure $E_m$ in step S9. In step S10, the optical system (11, 12 and 13) and the original table (not shown) carrying the original 10 thereon are moved in the forward direction to scan the original. The surface potential $V_L$ of the original is measured and is integrated for a scanning period T. In the automatic exposure mode, the exposure is corrected in the following manner. That is, when the final exposure in the case of manual exposure control is represented by $E_m$, final exposure $E_L$ by automatic exposure control is given by:

$$E_L = E_m + \sigma\left(\frac{1}{T}\int_0^T V_L dt - A_0\right) \quad (3)$$

wherein $A_0$ is the standard value obtained when the integrated value of the surface potential of the original is divided by T, that is, $A_0$ is the bright potential obtained with a standard white plate with a standard light quantity.

Since the scanning period T can vary depending upon the original size, the reduction scale, magnification scale and the like, such data is supplied from a sequence control microcomputer to the MPC 15.

In step S11, it is discriminated if the mode is the automatic exposure mode. If the mode is the automatic exposure mode (YES in step S11), the original exposure is set to $E_L$ given by control scheme (1) above in step S12.

On the other hand, if the mode is the manual exposure mode (NO in step S11), the exposure is set to $E_m+\Delta E_m$, which is the sum of the final exposure $E_m$ for manual exposure control and the correction amount $\Delta E_m$ from the exposure dial, in step S13.

Thereafter, the above-mentioned optical system and the original table are returned to their original positions to complete the copy sequence, in step S14.

In the embodiment described above, the image formation conditions are performed in the period after the copy key is depressed, and thereafter the original density is detected. However, the standardization may alternatively be performed after the main switch is turned on.

Alternatively, the standardization may be performed after the main switch is turned on, and the detection of the original density may be performed after the copy key is depressed.

The detection of the original density in the automatic exposure mode may be performed over the entire surface of the original or only a region thereof. When the detection of the original density is performed for a region of the original surface, the scanning period T must be corrected so that the original density of this region may always be detected even if the scanning speed is changed due to magnification or reduction.

In the embodiment described above, original exposure is performed during the return movement of the optical system and the original table. However, if the original is exposed during the forward movement of the optical system, part of the optical system may be moved forward for detection of the original density before scanning for original exposure.

In the embodiment described above, the surface potential of the original is integrated so as to control the original exposure light quantity. However, the development bias may be controlled by the integrated value of the surface potential of the original by switching the switch 34 shown in FIG. 2 in accordance with the automatic or manual exposure mode.

It is also possible to detect the image signal of the original as an electrostatic latent image potential, to obtain the ratio of its spatial frequency components, and to change the frequency of the AC component of the development bias voltage, thereby controlling the development gradation. Switching of the AC component may be performed by switching the oscillation frequency by a switch **30*a* as shown in FIG. 2**.

Furthermore, in the embodiment described above, the detection of the surface potential of the original is limited to the surface portion opposing the potentiometer of the photosensitive body. Therefore, it is also possible to incorporate a plurality of sensors in a direction perpendicular to the rotating direction of the photosensitive body or to incorporate a transverse scanning optical system in part of the optical path so as to detect the density of the original. In this case, the sensor may be oscillated transversely to increase the detection region and to improve the detection precision.

Measurement of the original density may be performed not only during the forward movement of the original table but also during prescanning before exposure scanning such as prerotation of the drum for preexposure and precleaning. That is, measurement of the original density must be performed before exposure for image formation.

In the manual exposure mode, the development bias must be changed manually.

In the foregoing description, the exposure and development bias are controlled as the image formation conditions. However, the present invention is not limited to this. For example, the charge status may be controlled by detection of the density of the original.

In summary, according to the present invention, the surface potential of the recording medium is integrated and the original image density is measured. In accordance with the measured value, the image formation conditions are corrected. Therefore, optimal image recording may be performed for any type of original.

What I claim is:

1. An image apparatus comprising:

image forming means for forming an image on a recording medium in accordance with an original image;

detecting means for detecting a density of the original image;

control means for integrating an output from said detecting means for a predetermined period of time and for controlling an image formation condition in accordance with the integrated output, said control means being operative in a first mode in which the image formation condition is controlled in accordance with the integrated output, and being operative in a second mode in which the image formation condition is controlled in a predetermined manner independently of the density of the original; and selecting means for selecting one of the first and second modes.

2. An apparatus according to claim 1, wherein the predetermined period of time is a scanning period for detection of the density of the original image, and said control means integrates the output from said detecting means for the scanning period and controls the image formation condition in accordance with an integrated output.

3. An apparatus according to claim 1 or 2, wherein said image forming means includes exposure means for exposing an original and said control means controls the operating condition of said exposure means in accordance with the integrated output.

4. An apparatus according to claim 1 or 2, wherein said detecting means detects the density of the image formed on the recording medium.

5. An apparatus according to claim 4, wherein said image forming means includes means for forming an electrostatic latent image on the recording medium, and said detecting means includes means for detecting a potential of the electrostatic latent image on the recording medium.

6. An apparatus according to claim 2, wherein the scanning period varies in accordance with an original size or an image recording magnification.

7. An apparatus according to claim 1, wherein said detecting means detects the density of the original image before image recording.

8. An apparatus according to claim 7, wherein said detecting means standardizes the image formation condition before detecting the density of the original image.

* * * * *